United States Patent [19]

Moore

[11] 4,288,120

[45] Sep. 8, 1981

[54] DOOR LATCH ASSEMBLY

[76] Inventor: Donald H. Moore, Rte. #3, Cannon Falls, Minn. 55009

[21] Appl. No.: 38,920

[22] Filed: May 14, 1979

[51] Int. Cl.[3] ..... E05C 13/00

[52] U.S. Cl. ..... 292/341.18

[58] Field of Search ..... 292/341.18, 341.19, 292/340

[56] References Cited

U.S. PATENT DOCUMENTS

| | | | |
|---|---|---|---|
| 964,789 | 7/1910 | Kozlowski | 292/341.18 |
| 1,793,115 | 2/1931 | Model | 292/341.18 |
| 2,412,497 | 12/1946 | Edwards | 292/341.18 |
| 2,486,772 | 11/1949 | Wuerl | 292/341.18 |
| 2,713,506 | 7/1955 | Wickstrom | 292/341.18 |
| 3,395,935 | 8/1968 | Rosenberger | 292/341.18 X |
| 4,113,293 | 9/1978 | Paguette | 292/341.18 |

*Primary Examiner*—Richard E. Moore

*Attorney, Agent, or Firm*—Dorsey, Windhorst, Hannaford, Whitney & Halladay

[57] ABSTRACT

An improved door latch assembly having a striker plate with an adjustable locking notch. The adjustable locking notch is provided by an adjustable slide member mounted in sliding relationship to the striker plate and having threaded adjustment means.

6 Claims, 7 Drawing Figures

DOOR LATCH ASSEMBLY

BACKGROUND OF THE INVENTION

The present invention relates generally to an improved door latch assembly, and more particularly to a door latch assembly having a striker plate with an adjustable locking notch. Proper fitting of door latch assemblies into a door jamb requires significant experience and craftsmanship to avoid a loose, poorly fitting door. Accordingly, installation of door latch assemblies and in particular the striker plate by persons who are not craftsmen in the art often result in improperly fitted doors. A door which is poorly fitted results in loss of heat (or cool air in the summer) thereby causing an increase in energy costs. Even if a latch assembly is properly fit and installed, later adjustments will often become necessary because of doors which have swollen, shrunken or warped as a result of moisture or other weather conditions. Further adjustments may become necessary because of worn latch assemblies. Adjustment is normally made by removing the striker plate from the door jamb, plugging the mounting holes and then redrilling the same and repositioning the striker plate to achieve a proper fit. Eventually, such redrilling and refitting can lead to weakening or destruction of the door jambs.

Accordingly, there is a real need in the art for a door latch assembly having a striker plate with an adjustable locking notch, thus permitting correction and elimination of misalignment problems that result from poor craftsmanship, worn latch assemblies and swollen, shrunken, warped doors.

SUMMARY OF THE INVENTION

The present invention relates to an improved door latch assembly which overcomes the deficiencies of the prior art devices. Specifically, it relates to a door latch assembly having a striker plate with an adjustable locking notch to correct misalignment and fitting problems due to poor craftsmanship, worn latch assemblies and swollen, shrunken and warped doors. The improved latch assembly of the present invention includes a striker plate having a top plate and a bottom plate secured together to form a slide rail means therebetween. Both the top and bottom plates are fastened to the door jamb by screws. A slide member is adapted for sliding movement within the slide rail to form the adjustable locking notch. The locking notch is adapted for locking engagement with a corresponding protruding latch member for retaining the same in a latched position. A threaded member is swivelly connected at one end to a portion of the slide member and threadedly connected at its other end to a portion of the bottom plate. Appropriate rotation of the threaded member results in corresponding movement of the slide member relative to the striker plate and thus adjustment of the locking notch.

Accordingly, an object of the present invention is to provide an improved door latch assembly which eliminates adjustment and installation problems due to poor craftsmanship, worn latch assemblies and swollen, shrunken and warped doors.

Another object of the present invention is to provide an improved door latch assembly having a striker plate with an adjustable locking notch.

A further object of the present invention is to provide an improved door latch assembly having a striker plate in which the position of the locking notch can be easily and quickly adjusted.

These and other objects of the present invention will become apparent with reference to the drawings, the description of the preferred embodiment and the appended claims.

DESCRIPTION OF THE PREFERRED AND ALTERNATE EMBODIMENTS

Figure 1:
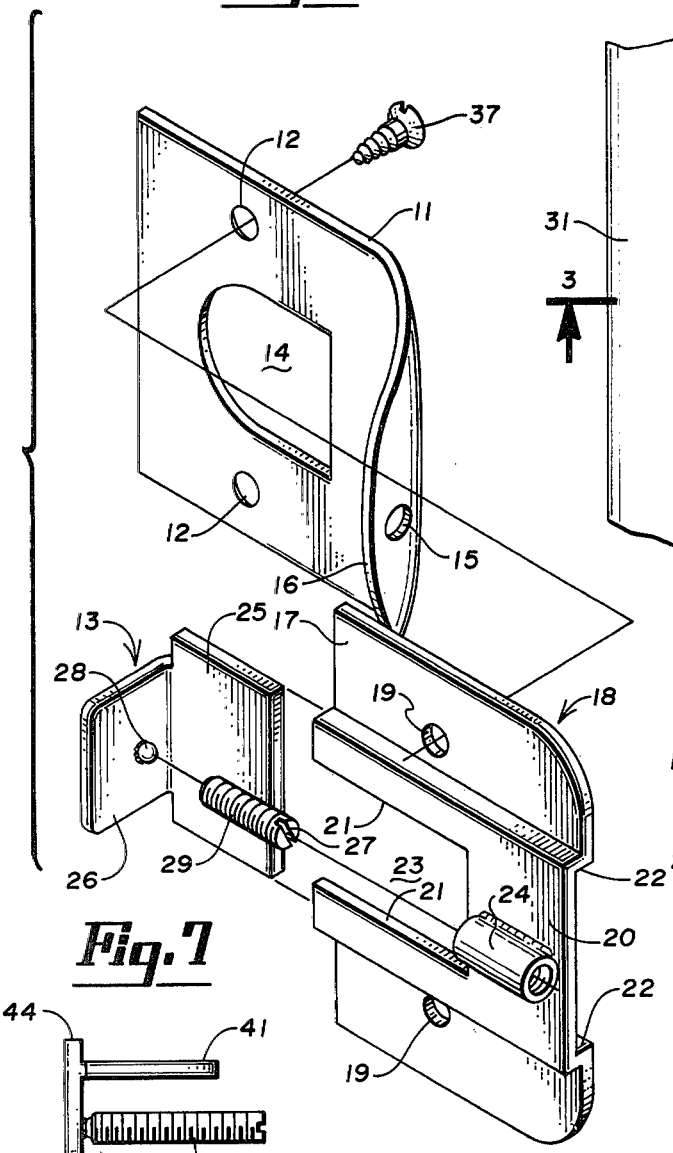
FIG. 1 is a broken apart, pictorial view of the door latch assembly of the present invention.
Figure 2:
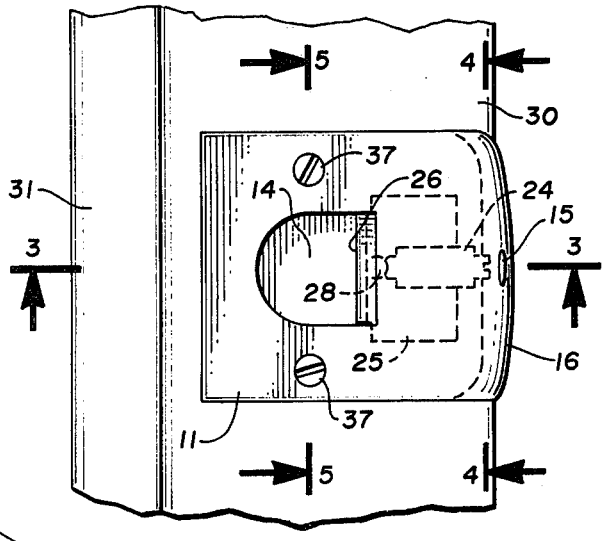
FIG. 2 is a plan view showing the door latch assembly of the present invention installed in a door jamb.

Reference is first made to FIG. 1 showing a broken apart, pictorial view of the improved latch assembly of the present invention. In particular, the improved latch assembly includes a strike or striker plate having a top plate 11, a bottom plate 18 and an adjustable slide member 13. The top plate 11 of the strike comprises a flat, generally rectangular element having a pair of holes 12 for appropriate connection to a door jamb 30 (FIG. 2) by a pair of screws 37. The plate 11 also includes a latch opening or locking notch 14 into which a corresponding locking member is intended to seat. The forward edge of the plate 11 which is normally disposed toward the direction in which the door opens includes a tongue or lip portion 16 which curves outwardly over the edge of the door jamb 30 as shown best in FIG. 3. Centrally positioned within the tongue or lip 16 is an opening 15 which, as will be discussed below, provides access to the adjustment means for the slide member 13. The lip 16 must extend sufficiently past the edge of the door jamb 30 to permit alignment between the opening 15 and the adjustment means.

The botton plate 18 conforms generally to the shape of the striker plate 11 and comprises a pair of side edge sections 17 each of which includes an opening 19 adapted for alignment with the openings 12 of the top plate 11 for connection to the door jamb. Disposed inwardly from each of the edge sections 17 is a centrally disposed raised portion 20. The raised portion 20 is a flat section lying in a plane spaced from and generally parallel to the plane in which the side edge sections 17 lie. The raised portion 20 and the side edge sections are joined by the shoulder portions 22. Rearwardly of the raised portion 20 are a pair of elongated raised slide rail legs or sections 21 which are integrally formed with and lie in the same plane as the section 20 and comprise an extension thereof. Each of the rail legs 21 extends inwardly from their respective shoulder portions 22 for a limited distance to define a slide rail and to define an opening 23 therebetween. The width of the opening 23 approximates the width of the opening or locking notch 14 in the top plate 11. Secured to the portion 20 is a generally cylindrically shaped, internally threaded member 24 centrally disposed on the raised portion 20 with its longitudinal axis lying along a longitudinal axis of the bottom plate 18. This threaded member forms part of the adjustment means of the present invention. In the preferred embodiment, the member 24 is secured to the section 20 by welding although various other forms of construction could be utilized such as the alternate embodiment shown in FIG. 6.

Figure 4:
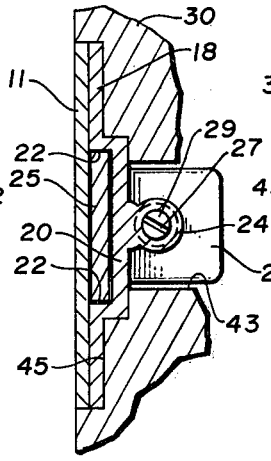
FIG. 4 is a sectional view of the door latch assembly of the present invention as viewed along the section line 4—4 of FIG. 2.
Figure 5:
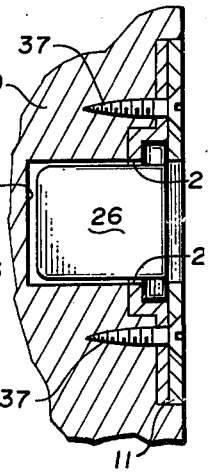
FIG. 5 is a sectional view of the door latch assembly of the present invention as viewed along the section line 5—5 of FIG. 2.
Figure 7:
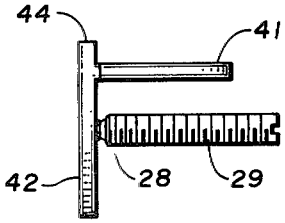
FIG. 7 is a side view of an alternate embodiment of the slide member.
Figure 3:
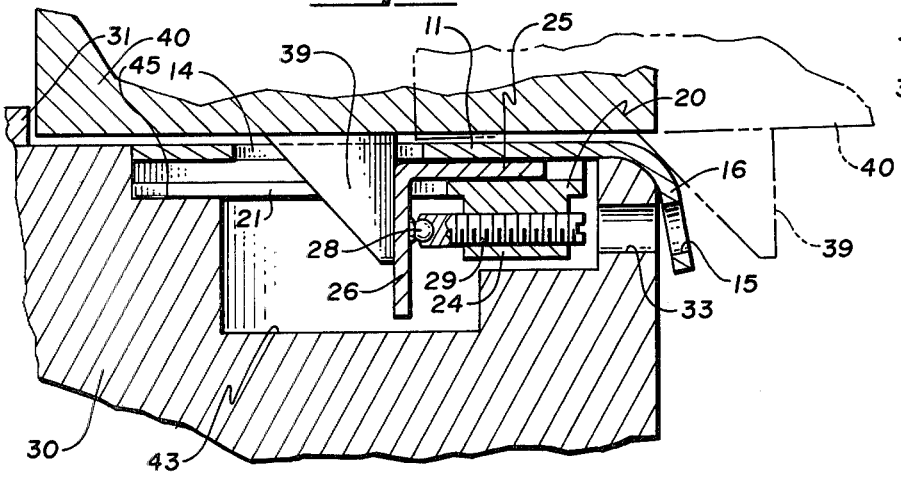
FIG. 3 is a sectional view of the door latch assembly of the present invention as viewed along the section lines 3—3 of FIG. 2.

When installed in the door jamb 30 in conjunction with the top plate 11 as shown in FIGS. 3, 4 and 5, the bottom plate 18 is positioned immediately below the top plate 11, thereby forming a space or slide rail means between the central portion of the plate 18 (the raised portion 20 together with the rail legs 21) and the bottom surface of the top plate 11. This slide means is adapted to slidably receive the slide member 13 to form the adjustable locking notch.

The slide member 13 comprises a generally "L" shaped member having a first generally flat rectangular slide plate or portion 25 adapted for sliding movement within the slide rail means formed between the top plate 11 and the raised portions 20 and 21 of the bottom plate 18. Accordingly, the lateral dimensions of the slide plate 25 are slightly smaller than the lateral dimension between the shoulder portions 22. Similarly, the thickness of the plate 25 is slightly less than the height of the shoulder 22 to permit free sliding movement of the plate 25 within the slide rail means. The slide member 13 also includes a second generally rectangular section in the form of the locking plate or portion 26 which is integrally formed with the slide plate 25 and extends downwardly therefrom at right angles. The locking portion 26 has a lateral dimension slightly smaller than the distance between the inner edges of the rail legs 21 to permit the same to move freely back and forth therebetween. As illustrated best in FIGS. 1 and 3, an elongated, externally threaded member 29 is swivelly connected at one end to a surface of the locking plate 26 by the conventional ball and socket swivel member 28. The other end of the threaded member 29 includes a slotted portion 27 for engagement by a screwdriver or the like. As illustrated best in FIGS. 1, 3 and 4, the elongated threaded member 29 is adapted for threaded engagement with the internally threaded member 24 connected to the raised portion 20. Because of the swivel connection between the member 29 and the locking plate 26, the threaded member 29 can be rotated relative to the member 24, thereby causing relative sliding movement of the slide plate 25 and thus the entire slide member 13 within the slide rail means formed between the top and bottom plates 11 and 18.

When fully installed, access to the slot 27 of the threaded member 29 is obtained through the forward opening 15 of the lip 16 of the top plate 11. By insertion of a screwdriver through such opening, the threaded member 29 can be rotated, thereby resulting in corresponding sliding movement of the slide member 13 within the slide and thus adjustment of the locking notch of the striker plate and door latch assembly.

Reference is next made to FIGS. 2, 3, 4 and 5 showing use of the latch assembly of the present invention when installed in a door jamb. When installing the assembly, normal procedure is followed. First, an area 45 of the door jamb 30 conforming to the shape of the striker plate is chiselled out so that when installed, the top surface of the plate 11 is flush with the door jamb 30. Next, the area 43 is chiselled out of the door jamb 30 to accommodate the adjustable lip member 13 and the related internally threaded member 24. A hole 23 (FIG. 3) is also drilled in the edge of the door jamb 30 to provide access to the threaded member 29. The latch assembly is then secured to the door jamb 30 within the chiselled out portion by screws 37 inserted through the openings 12 and 19 in the striker plate 11 and the bottom plate 18, respectively. When installed, the hole 15 in the lip 16, the hole 23 in the jamb 30 and the threaded member 29 are aligned so that a screwdriver can be inserted through the opening 15 to rotate the member 29. Rotation of the threaded member 29 moves the slide member 13 along the slide relative to the striker plate. For example, rotation of the member 29 in a clockwise direction moves the lip member toward the left as viewed in FIG. 3, while rotation of the member 29 in a counterclockwise direction moves the lip member to the right as viewed in FIG. 3. This relative movement results in adjustment of the effective size of the locking notch 14 (FIG. 1) of the striker plate 11.

Also shown in FIG. 3 is the edge of a door 40 in various positions as it is being moved toward its closed position. As shown, the door 40 includes a corresponding protruding latch member 39. As the door is being closed (phantom illustration in FIG. 3) the angled surface of the latch member 39 first engages the leading or forward edge of the plate 11, thereby causing the latch member 39 to be moved inwardly into the edge of the door 40. As a result of further closing movement of the door 40, the door is moved to a closed position in which the edge of the door abuts the door moulding 31. When in this position, the latch member 39 is released and falls into the locking notch 14 (FIG. 1), engaging the locking plate portion 26 of the slide member 13. By appropriate adjustment of the threaded member 29, the position of the locking plate 26 can be adjusted so that it properly and tightly retains the protruding latch member 39 and thus the door 40. If the door should become warped or if it swells or shrinks due to weather conditions or other factors, the position of the locking plate 26 can be accordingly adjusted to account for this condition, thus maintaining a properly fitted latch assembly.

FIG. 5 shows an end view of an alternate embodiment of the bottom plate in which the internally threaded portion 38 is formed by appropriately bending the plate and forming threads on the inside surface thereof. This embodiment is distinguished from the preferred embodiment of FIGS. 1-5 in which the threaded member 24 is welded to the bottom plate. Various other alternatives are also possible.

Figure 6:
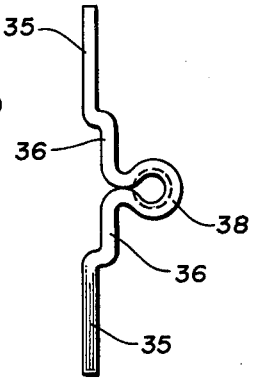
FIG. 6 is an end view of an alternate embodiment of a bottom plate.

FIG. 6 shows an alternate embodiment for the slide member 13. As illustrated, this alternate embodiment differs from the preferred embodiment in that it includes a lip portion 44 extending above the position at which the slide plate 41 is joined with the locking plate 42. The width of the portion 44 approximates the distance between the respective rail legs 21 (FIG. 1) to permit free sliding movement therebetween. When installed, the top of the portion 44 is intended to form a flush surface with the top of the plate 11. This permits a somewhat greater surface area of the latch member 39 (FIG. 3) to abut against when the door is in its closed and latched position.

Although the description of the preferred embodiment of the present invention has been quite specific, it is contemplated that various changes could be made to such embodiment without deviating from the spirit of the present invention. Accordingly, it is intended that the scope of the present invention be dictated by the appended claims rather than by the description of the preferred embodiment.

I claim:

1. A latch assembly comprising:

a striker plate having front and rear surfaces and having a latching notch therein;

an adjustable latching surface disposed within said latching notch and adapted for latching engagement with a corresponding protruding latch member for retaining the same in a latched position, said latching surface comprising an "L" shaped slide member slidably associated with a portion of the rear surface of said striker plate;

slide rail means for slidably receiving said slide member, said slide rail means including a slide rail plate having a pair of generally parallel peripheral edges connected in face-to-face registration with the rear surface of said striker plate on either side of said latching notch and an intermediate section disposed between said peripheral edges, said intermediate section being spaced from, but in parallel relationship to, the rear surface of said striker plate and having portions extending inwardly from each of said peripheral edges for slidably retaining said slide member;

threaded means for adjusting the position of said latching surface, said threaded means having a portion connected with said slide rail plate and being disposed on the opposite side of said slide rail means from said striker plate.

2. The latch assembly of claim 1 wherein the means for adjusting the position of said surface includes a first threaded member connected with said slide member and a corresponding second threaded member connected with a portion of said striker plate.

3. The latch assembly of claim 2 wherein said slide member comprises a generally "L" shaped member having a slide portion adapted for sliding movement within said slide rail means and a locking portion disposed at generally right angles to said slide portion and defining said surface.

4. The latch assembly of claim 3 wherein said first threaded member is swivelly connected with said slide member.

5. The latch assembly of claim 4 wherein said locking portion includes a lip portion which is flush with the outer surface of said striker plate.

6. The latch assembly of claim 5 wherein said striker plate includes a curved lip portion at one end with a hole therein to provide access to said threaded member.

* * * * *